United States Patent [19]

Cantley et al.

[11] 4,013,034

[45] Mar. 22, 1977

[54] STEERING CONTROL DEVICE

[75] Inventors: George A. Cantley, Akron; John E. Litzell, Hudson, both of Ohio

[73] Assignee: Incom International Inc., Pittsburgh, Pa.

[22] Filed: Mar. 10, 1975

[21] Appl. No.: 556,687

[52] U.S. Cl. ..... 116/31; 114/144 R; 116/126

[51] Int. Cl.[2] ..... B60Q 1/42; B63H 25/36

[58] Field of Search ..... 116/31, 126, 124 R, 116/129 F; 114/144 R, 162

[56] References Cited

UNITED STATES PATENTS

| | | | |
|---|---|---|---|
| 1,173,680 | 2/1916 | Peters et al. | 116/126 X |
| 1,517,760 | 12/1924 | Slonecker | 116/31 |
| 2,845,893 | 8/1958 | Eshbaugh et al. | 116/31 |
| 3,072,091 | 1/1963 | Booth | 116/31 |
| 3,165,088 | 1/1965 | Hill et al. | 114/162 X |
| 3,372,668 | 3/1968 | Chambers | 116/31 |

*Primary Examiner*—Richard C. Queisser
*Assistant Examiner*—Daniel M. Yasich
*Attorney, Agent, or Firm*—James C. Wray

[57] ABSTRACT

The present invention relates to a steering control device comprising a shaft for operative attachment to a steering system, said shaft rotatably mounted on a housing, a pinion gear means mounted on said shaft to rotate therewith, said housing including a hub member, with a hole therethrough for rotatable passage of said shaft, an indicator disc rotatably mounted on said hub coaxial with said shaft, an idler gear rotatably mounted on said disc, said pinion gear meshing with and driving said idler gear about a ring gear means outward of and surrounding and meshing with said pinion gear in response to the rotation of said shaft, said idler gear thereby driving said indicator disc.

10 Claims, 2 Drawing Figures

STEERING CONTROL DEVICE

BACKGROUND OF THE INVENTION

The present invention relates to a steering control device comprising a shaft for operative attachment to a steering system, said shaft rotatably mounted on a housing, a pinion gear means mounted on said shaft to rotate therewith, said housing including a hub member, with a hole therethrough for rotatable passage of said shaft, an indicator disc rotatably mounted on said hub coaxial with said shaft, an idler gear rotatably mounted on said disc, said pinion gear meshing with and driving said idler gear about a ring gear means outward of and surrounding and meshing with said pinion gear in response to the rotation of said shaft, said idler gear thereby driving said indicator disc.

The operation of certain vehicles requires that the steering mechanism be remote from the steering means such as the rudder or the like and therefore it is desirable to have some means or form indicating to the operator of the vehicle or boat the position of the steering means relative to the "amidship's" position of the vehicle. For example, in marine applications a rudder is typically provided rearwardly of the boat whether forming a part of an outboard motor or as a part of an inboard driving system. In such position, the operator, when operating the boat, is unable to visually determine the rudder position from time to time. There are times that he must be fully aware of the position of the rudder, for without that knowledge damage or serious injury might result upon the starting and shifting of the drive engine. specifically, if the boat is dockside, that is, adjacent to a dock facility, and the rudder is positioned hard over, starting and shifting of the motor could send the boat directly into the dock causing damage to the boat itself and possible personal injury to its occupants. Similarly, the operator should know, on a timely basis, the position of the rudder in an open sea condition. If, for example, the rudder is positioned at one extreme or the other, starting and shifting of the engine may easily result in capsizing which in itself could result in serious injury. Further, in adverse weather conditions and when navigating by compass or other means, it is particularly helpful to the operator to know the general relative position of the rudder in relation to the compass reading.

There are numerous prior art devices for indicating the position of a boat rudder with respect to a boat steering wheel. However, these devices are extremely complicated and unreliable and require a great number of gears, cables and other mechanical linkages to link the rudder system to this steering wheel. These devices, because of the great number of parts involved, are typically expensive to manufacture, install and to maintain.

Typical prior art examples are to be found in U.S. Pat. No. 1,173,680 to Peters, et. al.; U.S. Pat. No. 1,517,760 to Slonecker; U.S. Pat. No. 2,845,893 to Eshbaugh, et. al., and U.S. Pat. No. 3,203,390 to Boda. Each of these patents represent complex mechanisms to present to the operator a relative position indicator of the steering system which is being manipulated by that operator. Each of these prior art approaches include a number of intermeshing gears being driven or responsive to the movement of the shaft to which the steering or mechanism is attached. Each of these prior art approaches through their complexity could actually cause jamming of the steering system or train which defeats the entire purpose of the device. That is, each of these prior art approaches introduces a potential for a jamming of the steering systems to which they are operatively attached.

Another example of an unsuitable form of a rudder position indicating means is to be found in U.S. Pat. No. 3,165,088 to Hill, et. al. This patent discloses a rudder position utilizing a weight means to denote a reference point. While this particular device may not interfere with the steering system with which it is associated, it will, however, give relatively unreliable readings.

SUMMARY OF THE INVENTION

It is, therefore, a primary object of the present invention to provide a steering control device comprising a shaft for operative attachment to a steering system, said shaft rotatably mounted in a housing adjacent a steering wheel, a pinion gear means mounted on said shaft to rotate therewith, said housing including a hub member adjacent a steering wheel, with a hole therethrough for rotatable passage of said shaft, an indicator disc rotatably mounted on said hub coaxial with said shaft, an idler gear rotatably mounted on said disc, said pinion gear meshing with and driving said idler gear about a ring gear means outward of and surrounding and meshing with said pinion gear in response to the rotation of said shaft, said idler gear thereby driving said indicator disc.

It is yet another object of the present invention to provide a steering control device adapted to marine applications which is simplistic in design.

It is still another object of the present invention to provide a steering control device which will not cause a jamming of the steering system with which it is operatively connected.

It is still another important object of the present invention to provide a steering control device which will effectively present to the operator of the device the relative position of the steering means, such as a rudder, with respect to its amidship's position.

It is yet another object of the present invention to provide an improved steering control device capable of being inexpensively manufactured utilizing high volume automated manufacturing techniques.

It is still another object of the present invention to provide a steering control device wherein the indicator disc has indicating means disposed thereon to indicate the relative position of the steering system and the steering means to which said steering system is operatively attached.

It is a further object of the present invention to provide a steering control device wherein the hub has a window therein through which the position of the indicating means can be viewed by the operator.

It is still another object of the present invention to provide a steering control device wherein the device is adapted to operatively control a marine steering system which in turn controls a rudder means, the housing being adapted to be attached to a bulkhead, indicating the relative position of the rudder means with respect to its associated amidship's position.

It is yet another object of the present invention to provide a steering control device wherein the ring gear is formed on the inner surface of the hub.

It is still another object of the present invention to provide a steering control device wherein the indicator disc is rotatably mounted on an axial extension of the hub, the extension comprising at least one axially position the indicator disc on the hub.

It is still another object of the present invention to provide a steering control device wherein the idler gear is rotatably mounted on the indicator disc, the extension offset from the center of the disc, the extension comprising at least one axially extending finger which may be flexed to rotatably accommodate and axially position the idler gear on the disc to drive the disc in response to the rotation of the shaft.

It is yet another object of the present invention to provide a steering control device wherein the pinion gear and the idler gear are manufactured from a plastic material.

It is still another object of the present invention to provide a steering control device wherein the hub encloses the pinion gear, the idler gear and the indicator disc thereby protecting them from the outside environment.

Still other objects, features and attended advantages of the present invention will become apparent to those having skill in this art from a reading of the following detailed description fo the preferred embodiments constructed in accordance therewith, taken in conjunction with the accompanied drawings wherein like numerals designate like parts in the several figures.

DESCRIPTION OF THE INVENTION

Figure 2:
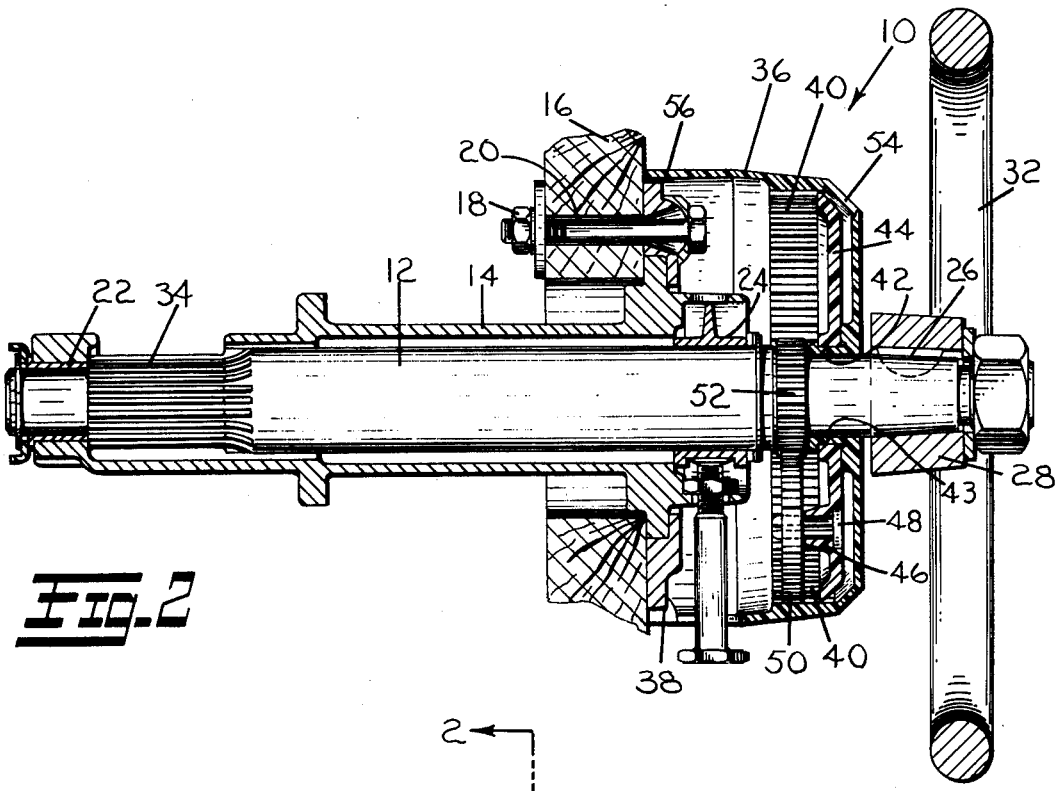
FIG. 2 is a side sectional view of the steering control device of FIG. 1 taken along line 2—2.
Figure 1:
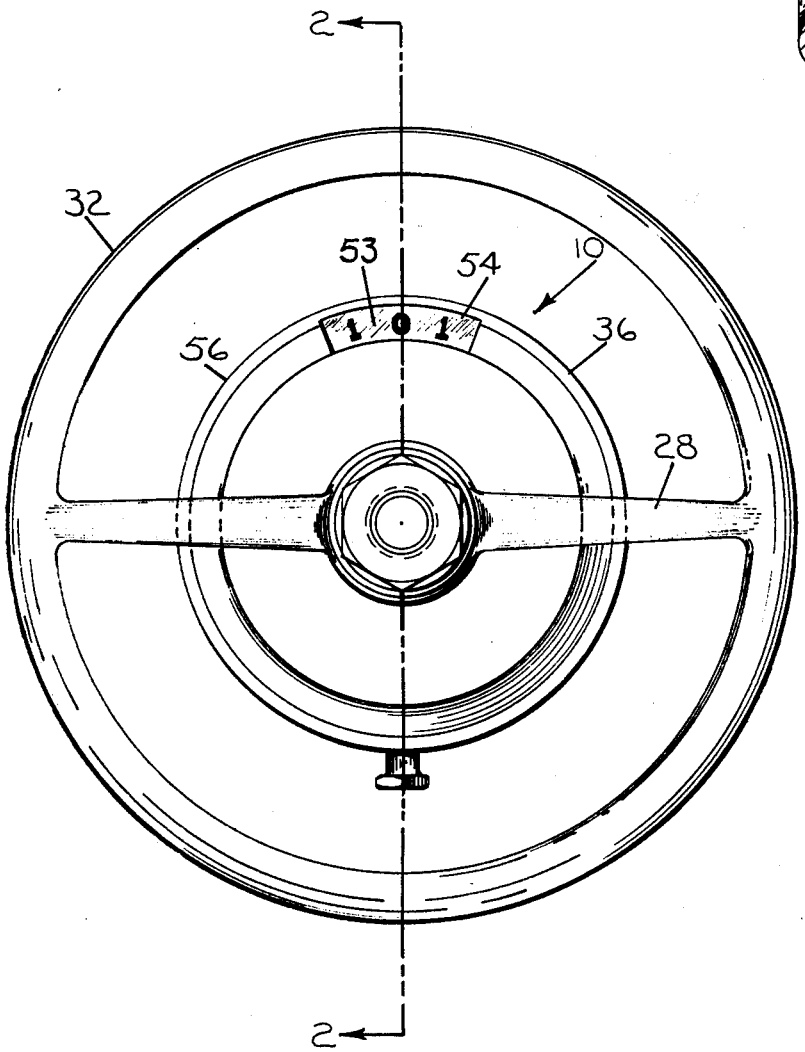
FIG. 1 is a front elevational view of a steering control device in accordance with the present invention.

Referring now to the drawings and, in particular, FIGS. 1 and 2 therein show an improved steering control device 10 in accordance with the present invention. The steering control device 10 is particularly adapted and suited for marine environments and more specifically adapted to control a marine steering system which is operatively connected to a rudder or the like (not shown) which effects the steering of the boat with which it is associated.

The steering control device 10 is provided with a shaft 12 which is rotatably supported within a housing 14. The housing 14 may include a number of component parts and provides the means by which the steering control device 10 may be fixedly attached to a bulkhead 16 or the like. The steering control device 10 can be so attached to the bulkhead 16 at its housing 14 by suitable fastening means such as a nut 18 and bolt 20 arrangement.

The shaft 12 is rotatably supported within the housing 14 by means of a first bearing 22 and a second bearing 24. The second bearing 24 could be provided with suitable adjusting means which could vary the tolerance between the second bearing 24 and the shaft 12. The shaft 12 may be provided with a taper 26 or other suitable connecting means on which a steering wheel 28 or the like may be fixedly mounted. The steering wheel 28 could be further secured to the shaft 12 by additional fastening means such as a nut 30. Further, the steering wheel 28 is provided with an annular rim 32 which may be grasped by the hands of the operator (not shown) to rotate the shaft 12.

The shaft 12 may be provided at its other end with suitable rudder turning gearing means 34 which may be operatively connected to a steering system (not shown) which in turn may be operatively connected to a rudder or other steering mechanism which would be moved in response to the clockwise or counterclockwise rotation of the steering wheel by the operator.

The steering control device is further provided with an axially extended hub 36 which encloses the major components included and comprising the present invention. The axially extended hub 36 is suitably attached to the housing 14 by suitable fastening means such as lip 38, which fixedly engages the housing 14 and maintains both the axial and radial position of the hub with respect to the shaft 12. Obviously, additional attaching and fixing means may be provided to attach the axially extending hub 36 to the housing 14 of the steering control device 10.

The axially extending hub 36, which may be manufactured from a variety of suitable materials such as ABS — medium impact plastic, has formed on its inner surface internal gear teeth 40. Obviously, the internal gear teeth 40 may be formed on a ring to form a ring gear and press fitted within the axially extending hub 36, or may be molded integrally with and into the hub 36. The axially extending hub is provided with an axial extension 42 formed coaxially with the shaft 12. The axial extension 42 may be formed from several flexible or deformable fingers 43 which may be flexed to accommodate an indicator disc 44 to rotatably support the indicator disc 44 on the outer surface of the axial extension 42.

The indicator disc 44 is provided with an aperture 46 disposed from the center line of the indicator disc. The aperture 46 is attached to rotatably support a shaft 48 which in turn is attached to rotatably support an idler gear 50. The indicator disc 44 may be manufactured from a wide range of suitable materials such as Celcon (trademark of Celenese Corporation of America). Similarly, the idler gear 50 may also be manufactured from a wide range of materials, including the above mentioned Celcon. The idler gear may be provided with suitable gear teeth and may be configured as an involute spur gear. The idler gear 50 is so disposed on the indicator disc 44 such that its gear teeth mesh with internal gear teeth 40.

The shaft 12 has fixedly attached thereto a pinion gear 52 which is in general radial alignment with the idler gear and the gear teeth of the pinion teeth 52 and in a meshing relationship with the gear teeth of the idler gear 50.

It can be seen, therefore, as the operator moves the steering wheel 28 in a clockwise or counterclockwise direction, the shaft 12 will be moved thereby rotating on the first bearing 22 and second bearing 24 to operate the steering system to which it is operatively attached at its gearing means 34. As the shaft 12 is so moved, the pinion gear 52 will move therewith. The pinion gear 52, which, as before noted, is in intermesh relationship with the idler gear 50, will rotate the idler gear as the shaft 12 is rotated. This rotation of the idler gear 50 will be translated into rotational movement about the shaft 12 by the meshing relationship of the idler gear 50 with internal gear teeth 40. That is, the pinion gear 52 will drive the idler gear 50 as a blanket gear around the shaft. As the idler gear 50 is so moved about the shaft 12, it will, through shaft 48, drive the indicator disc 44 and rotate it about the shaft 12. The movement therefore of the idler disc 44 will be directly responsive to the motion of the shaft which is effected by the operator through the steering wheel 28. The hub 36 is further provided with a window 54 through which the operator can view the relative motion of the indicator disc 44. The indicator disc 44 may be provided with suitable indicating means 53 such as degrees, numbers or the like which may generally or specifically indicate the relative position of the steering means to which the steering control device is operatively attached. Accordingly, the operator will not have to look away from the area of the operation of the view to determine the position of the rudder or the like. And all that will be required will be to view the indicating numerals, degrees or the like on the idler disc.

The hub 36 may be provided with a skirt or other suitable extension 56 which will totally enclose the various working parts of the steering control device 10. This can be particularly important in marine applications in which the steering control might be exposed to salt air, spray and the like.

Certain materials have been indicated for the various parts that comprise the present invention. It is to be noted that these parts, as well as the other parts that comprise the steering control device, may be manufactured from a wide range of materials depending upon the specific environment and applications to which the device 10 may be put. Further, it has been noted that the steering control device 10 is particularly adapted to marine applications and it is to be further noted that the control device 10 is suitable for a number of other applications, including off-highway equipment and the like. The above described embodiments are shown by way of assembly and are described in detail without attempting to show all the various forms and modifications in which the invention might be embodied; the invention being measured by the appended claims and not the details of the specification.

We claim:

1. A steering control device comprising a shaft connected to a steering wheel and connected at a remote end to turning means for operative attachment to a steering system, said shaft rotatably mounted on a housing a pinion gear means mounted on said shaft to rotate therewith, said housing including adjacent the steering wheel a hub member, with a hole therethrough for rotatable passage of said shaft, the hub member having a flexible extension, an indicator disc rotatably mounted on said flexible axial extension coaxial with said shaft, an idler gear rotatably mounted on an extension parallel to the shaft on said disc, said pinion gear meshing with and driving said idler gear about a ring gear means connected to the housing hub outward of and surrounding the pinion gear and meshing with said idler gear whereby the pinion gear turns the idler gear and drives the idler gear about the ring gear means in response to the rotation of said shaft, said idler gear thereby driving said indicator disc.

2. A steering control device in accordance with claim 1 wherein said ring gear means is fixedly attached to said hub and disposed coaxially with said shaft.

3. A steering control device in accordance with claim 2 wherein said ring gear means is formed on the inner surface of said hub.

4. A steering control device in accordance with claim 2 wherein said indicator disc is rotatably mounted on an axial extension of said hub, said extension comprising at least one axially extending finger which may be flexed to rotatably accommodate and axially position said indicator disc on said hub.

5. A steering control device in accordance with claim 2, said extension offset from the center of said disc, said extension comprising at least one axially extending finger which may be flexed to rotatably accommodate and axially position said idler gear on said disc to drive said disc in response to the rotation of said shaft.

6. A steering control device in accordance with claim 2 wherein said pinion gear and said idler gear are manufactured from a plastic material.

7. A steering control device in accordance with claim 1 wherein the indicator disc has indicating means disposed on the disc to indicate the relative position of said steering system and the steering means to which said steering system is operatively attached.

8. A steering control device in accordance with claim 7 wherein said hub has a window therein through which the said indicating means can be viewed.

9. A steering control device in accordance with claim 7 wherein said device is adapted to operatively control a marine steering system which in turn controls a rudder turning gearing, said housing being adapted to be attached to a bulkhead, said indicating means indicating the relative position of said rudder turning means with respect to its associated amidship's position.

10. A steering control device in accordance with claim 9 wherein said hub encloses said pinion gear, said idler gear and said indicator disc thereby protecting them from the outside environment.

* * * * *